US006103202A

United States Patent [19]

Hall

[11] Patent Number: 6,103,202

[45] Date of Patent: Aug. 15, 2000

[54] CATALYTIC CONVERTER AND PIPE ASSEMBLY

[75] Inventor: Michael G. Hall, Clio, Mich.

[73] Assignee: General Motors Corporation, Detroit, Mich.

[21] Appl. No.: 09/039,100

[22] Filed: Mar. 13, 1998

[51] Int. Cl.[7] ..... B01D 53/34

[52] U.S. Cl. ..... 422/177; 422/171; 422/180

[58] Field of Search ..... 422/171, 174, 422/177, 180, 168; 60/299, 300; 55/DIG. 30

[56] References Cited

U.S. PATENT DOCUMENTS

| | | | |
|---|---|---|---|
| 1,585,951 | 5/1926 | Waller | 285/322 |
| 2,768,008 | 10/1956 | Rheem | 285/179 |
| 2,878,838 | 3/1959 | Budge et al. | 138/74 |
| 2,952,306 | 9/1960 | Adler | 155/197 |
| 3,185,506 | 5/1965 | Szlashta | 285/183 |
| 3,381,318 | 5/1968 | Luijt | 4/211 |
| 3,844,586 | 10/1974 | Olen | 285/8 |
| 3,988,030 | 10/1976 | Twell | 285/183 |
| 4,415,141 | 11/1983 | Guenther | 256/69 |
| 5,094,073 | 3/1992 | Worner | 422/180 |
| 5,118,476 | 6/1992 | Dryer et al. | 422/180 |
| 5,121,948 | 6/1992 | Anderson et al. | 285/168 |
| 5,385,431 | 1/1995 | Topf, Jr. | 405/157 |

*Primary Examiner*—Hien Tran
*Attorney, Agent, or Firm*—Vincent A. Cichosz

[57] ABSTRACT

A catalytic converter and pipe assembly having a catalytic converter which includes a housing and an attached housing end. The housing end has a substantially flat surface with an opening. Mounted to the substantially flat surface is a pipe with a diameter having first and second ends wherein exhaust gas flows through the opening into the pipe. The first end of the pipe has an irregular ovoid shape and a plane that is at an acute angle to the outer surface of the pipe in the direction of exhaust flow. The catalytic converter and pipe assembly is capable of achieving a change of exhaust flow direction in a space that is slightly larger than the diameter of the pipe.

13 Claims, 2 Drawing Sheets

CATALYTIC CONVERTER AND PIPE ASSEMBLY

This invention relates to a catalytic converter and pipe assembly.

BACKGROUND OF THE INVENTION

In many automotive vehicles, the catalytic converter must be placed in a location constraining its size and the shape and clearance for its intake and outlet pipes. In some vehicles, the catalytic converter outlet pipe must make a turn as great as ninety degrees immediately downstream of the converter. This has been achieved in the past by fabricating a converter end cone of three pieces of metal drawn to shape and welded together to form an end cone chamber that receives the exhaust gases from the converter and quickly changes the direction of the gases.

SUMMARY OF THE PRESENT INVENTION

It is an object of this invention to provide a catalytic converter and pipe assembly.

Advantageously, this invention provides a catalytic converter and pipe assembly that changes the direction of gas flow immediately leaving or entering the catalytic converter while requiring less space than previously necessary to accomplish such a change in direction.

Advantageously, this invention provides a catalytic converter and pipe assembly that changes the direction of gas flow immediately leaving or entering the catalytic converter while eliminating the previously used multipiece end cone assemblies.

Advantageously, this invention provides a catalytic converter and pipe assembly that changes the direction of gas flow immediately leaving or entering the catalytic converter and that is suitable for use with catalytic converters with flat end plates or with ends having at least a portion that is substantially flat.

Advantageously, this invention provides a catalytic converter and pipe assembly that uses fewer components and is easier and more cost efficient to manufacture than previous devices for changing the direction of gas flow immediately leaving or entering the converter.

Advantageously, this invention makes use of a pipe having a first end with an opening having an irregular ovoid shape and a bend immediately adjacent to the first end. The first end has a plane that is at an acute angle to the outer surface of the pipe immediately adjacent to the first end. Preferably, the plane of the first end is parallel to the axis of the second end of the pipe, which axis is perpendicular to the axis of flow through the catalytic converter. The first end of the pipe is welded to a flat surface of an end of the catalytic converter, such as to a flat end plate.

Advantageously, in a preferred example, this invention provides a catalytic converter and pipe assembly comprising: a catalytic converter including a housing and a housing end attached thereto; a substantially flat surface on the housing end; an opening in the substantially flat surface; a pipe having a first end, a second end and a bend immediately adjacent the first end, wherein the first end is mounted to the substantially flat surface so that exhaust gas flows through the opening into the pipe, wherein the first end has an irregular ovoid shape, wherein the first end has a plane that is at an acute angle to an outer surface of the pipe in a direction of exhaust gas flow immediately adjacent to the first end, wherein the catalytic converter and pipe assembly achieve a change of exhaust flow direction in a space slightly larger than a diameter of the pipe.

BRIEF DESCRIPTION OF THE DRAWINGS

The present invention will now be described by way of example with reference to the following figures in which.

DETAILED DESCRIPTION OF THE INVENTION

Figure 1:
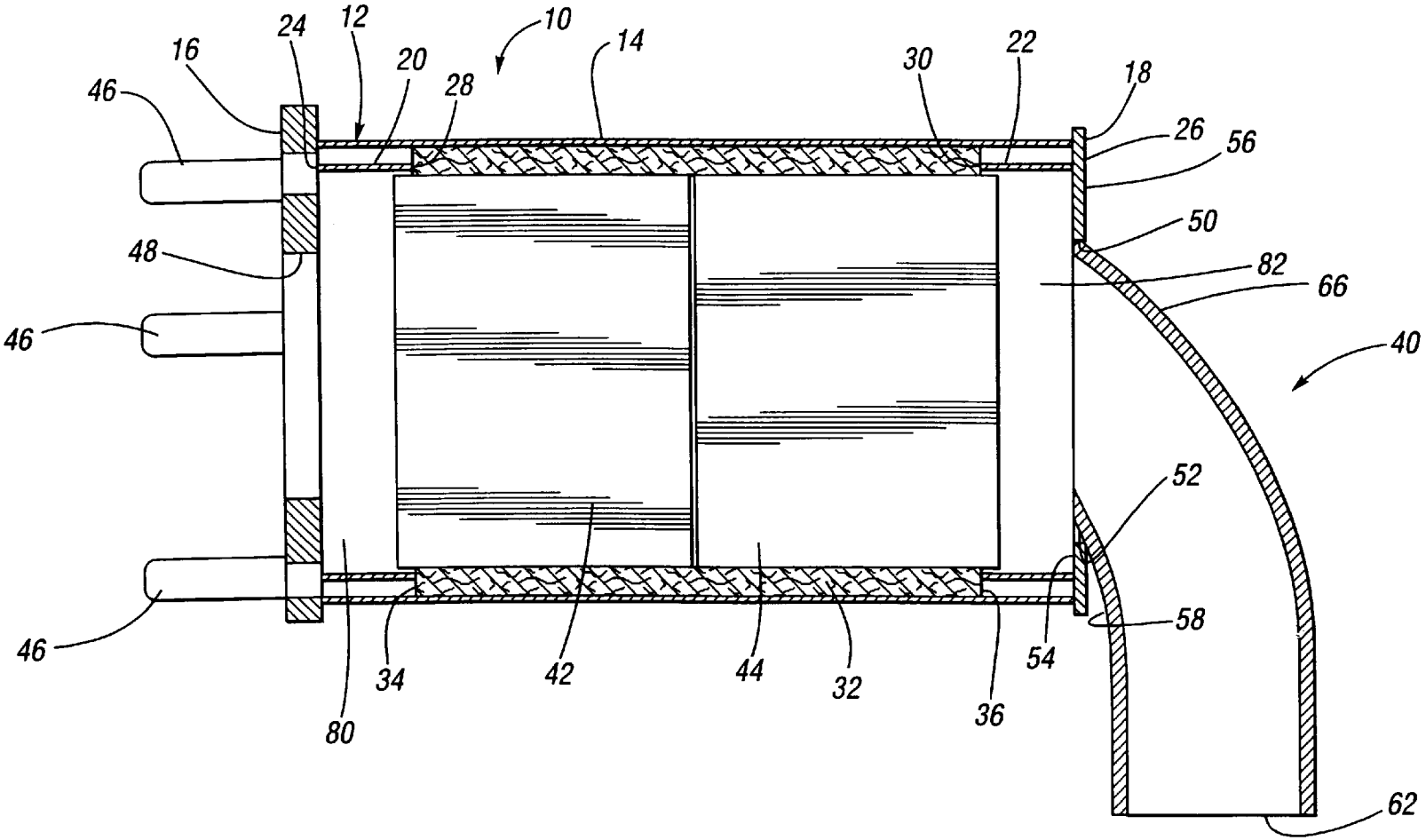
FIG. 1 illustrates and example catalytic converter and pipe assembly according to this invention.

Referring now to FIG. 1, the catalytic converter and pipe assembly 10 includes a catalytic converter 12 and a pipe 40 attached, in this example, to the converter's outlet end. The catalytic converter 12 includes a housing 14, an end plate 16 at the inlet end and an end plate 18 at the outlet end. The housing 14 in this example has a circular cylindrical shape. The housing is attached to the end plates 16 and 18 by welds of a known type that entirely seal the interfaces between the housing 14 and each end plate 16 and 18. The end plates 16 and 18 thus serve as the housing ends.

An inner cylinder 20 is located within the housing 14 near the inlet end. The inner cylinder 20 has a circular cylindrical shape with a first end 24 attached to the end plate 16, for example, by a weld, and a second end 28 that abuts the first end 34 of the matting 32. Another inner cylinder 22 is located within the housing 14 near the outlet end. The inner cylinder 22 has a circular cylindrical shape with a first end 26 attached to end plate 18, for example, by a weld, and a second end 30 that abuts the second end 36 of the matting 32. The inner cylinders 20 and 22 act as heat shields insulating the housing 14 from the heat of exhaust gas flowing through the converter 12 to keep the outer surface temperature of housing 14 cooler than it otherwise would be if the inner cylinders 20 and 22 were not present.

The matting 32 is an intumescent material of a known type used for catalytic converters. The matting 32 surrounds most or all of the cylindrical outer surfaces of substrates 42 and 44 and is compressed between the inner surface of housing 14 and the outer surfaces of the substrates 42 and 44 to hold the substrates 42 and 44 in place within the housing 14.

Housing 14 has an axial length providing for gaps 80 and 82 between the end plate 16 and substrate 42 and between the end plate 18 and substrate 44. These gaps, for example, being between one half inch and one inch long, are chambers allowing dispersion and contraction of the exhaust gas flow at the inlet and outlet ends, respectively, of the converter 12 so that the exhaust gas flows through all of the channels of the substrates 42 and 44 instead of being concentrated only in those channels near the radial center of the substrates 42 and 44.

The substrates 42 and 44 are any type of substrate suitable for use in a catalytic converter. Preferably, the substrates are extruded ceramic monoliths of a known type coated with one or more precious metal catalyst washcoats of a known type for aiding in the oxidation of unburned hydrocarbons in the exhaust gas stream and/or for other exhaust treatments known to those skilled in the art.

Studs 46 are attached, e.g., by welding, to the end plate 14 to facilitate connection of the converter 12 to a complementary flange of a known type of manifold down pipe (not shown) or other exhaust pipe as is necessary for the particular system implementation. Alternatively, an inlet pipe may have one end welded to the inlet opening 48 in the end plate 16 and another end welded or clamped to the manifold down pipe.

End plate 18 has an opening 50 of irregular ovoid shape to which the end 52 of pipe 40 is attached via a weld that seals the entire interface between the end plate 18 and the pipe 40. The end 52 of the pipe 40 has an irregular ovoid shape matching that of the opening 50, but slightly smaller, so that end 52 can fit within the opening 50. Because the portion 58 of the pipe 40 passes close to the outer surface 56 of the end plate 18, it may be difficult to weld the pipe 40 to the end plate 18 from the outer surface 56 side of the end plate 18. Thus, in this example, it is preferable to weld the pipe 40 to the end plate 18 at the inner surface 54 side of end plate 18 before the end plate 18 is attached to the housing 14.

Figure 2:
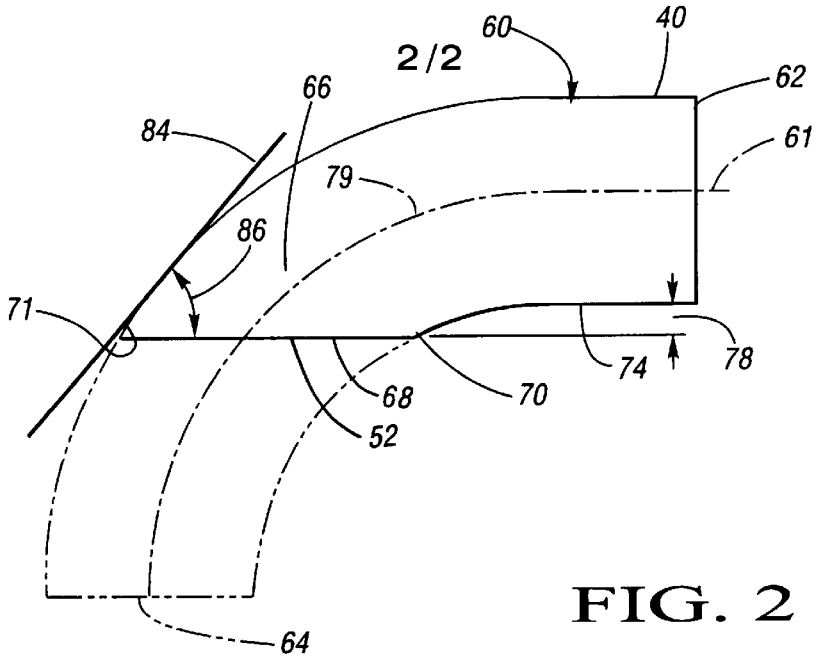
FIG. 2 illustrates an example side view of a pipe for use in the catalytic converter and pipe assembly shown in FIG. 1.
Figure 3:
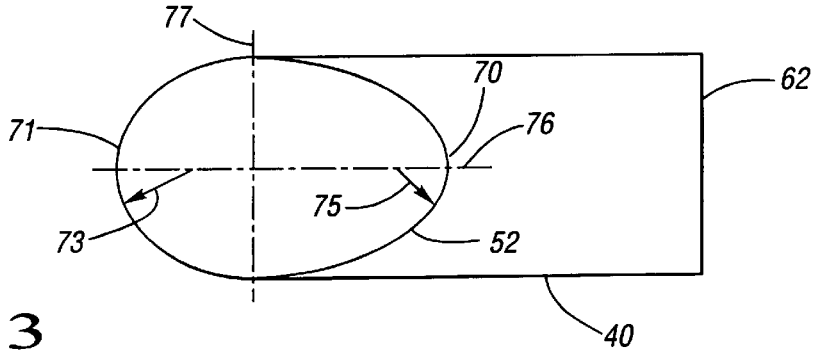
FIG. 3 illustrates an example end view of the pipe of FIG. 2.

FIGS. 2 and 3 illustrate an example of how the pipe 40 and the irregular ovoid shape of the end 52 are formed. A pipe stock 60 of round exhaust pipe is bent ninety degrees using a standard pipe bending machine. The two ends 62 and 64 of the pipe stock 60 still have the original circular shape and size. When a cut 68 is made through the bend 66 of the pipe 40 such that the plane of the cut is parallel to the axis 61 of the end 62, end 52 formed by the cut 68 has the irregular ovoid shape shown in FIG. 3.

The irregular ovoid is characterized by a major axis 76 that is parallel to the axis 61 of the end 62 of pipe 40 and about which the end 52 is symmetrical. One portion 71 of the end 52 crossing the major axis 76 has a larger radius of curvature 73 greater than the radius of curvature 75 of the other portion 70 of the end 52 that crosses the major axis 76. The portion 70 is closer to the end 62 than the portion 71. The irregular ovoid also has a minor axis 77 perpendicular to the major axis 76 and intersecting the major axis at the central flow line 79 (FIG. 2) through the pipe 40. The minor axis is closer to the portion 71 than to the portion 76.

The plane of the opening 52 is at an acute angle 86 to the radially outer surface of the pipe 40 in the flow direction immediately adjacent the end 52. The imaginary line 84 shown in FIG. 2 is tangent to the radially outer surface of the pipe 40 in the flow direction immediately adjacent to the end 52 and is included in FIG. 2 to illustrate the acute angle 86. The flow direction is the direction that exhaust gas flows through the pipe 40 from end 52 to end 62.

The opening 50 of the end plate 18 shown in FIG. 1 is of the same shape as the end 52 of pipe 40 but is slightly larger to allow end 52 to fit within opening 50.

An advantage of the pipe 40 formed as shown in FIGS. 2 and 3 is that the radially inner edge 74 of the pipe 40 that leads to end 62 can be closely spaced to the plane of the opening of end 52 of the pipe 40 and therefore close to the outer surface 56 of end plate 18. In one example in which the pipe stock 60 had an original diameter of 50 millimeters and the cut 68 was made where the major axis 76 had a length of 75 millimeters, a pipe 40 made to facilitate a ninety degree turn in exhaust gas flow was achieved with a distance 78 between the plane of end 52 and radially inner edge 74 of only 3.5 millimeters. In this example, the change of direction distance is the distance 78 plus the pipe diameter, or 53.5 millimeters. This example achieves the change of direction of exhaust gas in a distance from the surface 56 of less than 1.1 times the diameter of the outlet 62 of pipe 40. In other example implementations of this invention, this ratio of change of direction distance to pipe diameter might not be as good, but will typically be less than 1.5 times the diameter of the pipe 40 outlet 62. This contrasts to the 75 millimeters between the end 64 and the radially inner edge 74 and a ratio of change in direction distance to pipe diameter of 2.5 in a case where a circular shaped pipe end would be necessary.

In the example described above, the catalytic converter housing was circular cylindrical in shape. This invention can be used with any shape catalytic converter housing as long as one of the end plates to which the pipe is connected has a substantially flat surface. In another example, the housing 14 has an oval or ovoid shape. The pipe 40 can be attached to the end plate 18 even if the minor axis of the oval-shaped housing is smaller than the major axis of the irregular ovoid shaped end of the pipe 40 by aligning the major axis of the end of pipe 40 with the major axis of the housing. The change of direction illustrated above is about 90 degrees, but the change of direction could be greater or less. In one example, the change of direction may be substantially 75 degrees or more.

Figure 4:
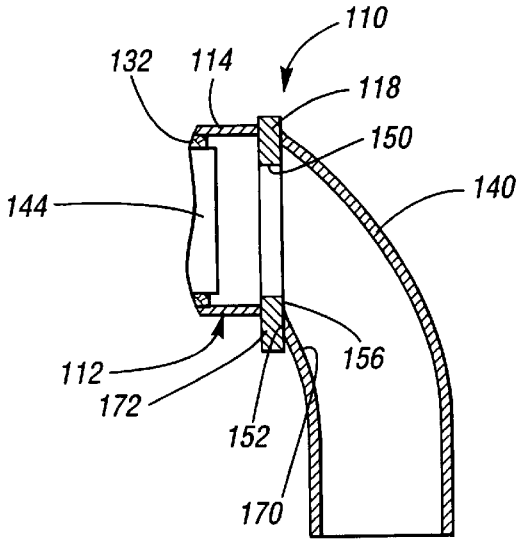
FIG. 4 illustrates another example catalytic converter and pipe assembly according to this invention.

In another example shown in FIG. 4, the catalytic converter and pipe assembly 110 includes catalytic converter 112 having a housing 114 with a diameter smaller than the major axis of the end 152 of the pipe 140. Matting 132 holds the substrate 144 within the housing 114 similar to the way that matting 30 shown in FIG. 1 holds substrate 44 in place. In this example, the opening 150 in the end plate 118 cannot be of size and shape to match the end 152 of pipe 140, so the opening 150 is smaller than the end 152 of pipe 140. The pipe 140 is welded to end plate 118 from the outer surface 156 side of end plate 118. To allow room for the welding tool from the outer surface 156 side of end plate 118, the small diameter portion 170 of end 152 of pipe 140 is located near the edge 172 of end plate 118. With this positioning, the entire interface between the pipe 140 and end plate 118 can be sealingly welded.

I claim:

1. A catalytic converter and pipe assembly comprising:

a catalytic converter including a housing and a housing end attached thereto;

a substantially flat surface on the housing end;

an opening in the substantially flat surface;

a pipe having a first end, a second end and a bend immediately adjacent the first end, wherein the first end is mounted to the substantially flat surface so that exhaust gas flows through the opening and into the pipe, wherein the first end has an irregular ovoid shape, wherein the first end has a plane that is at an acute angle to an outer surface of the pipe in a direction of exhaust gas flow immediately adjacent to the first end, wherein the catalytic converter and pipe assembly achieve a change of exhaust flow direction in a space slightly larger than a diameter of the pipe.

2. A catalytic converter and pipe assembly according to claim 1, wherein the irregular ovoid shape of the first end has a major axis and a first portion crossing the major axis with a first radius of curvature greater than a second radius of curvature of a second portion crossing the major axis opposite the first portion.

3. A catalytic converter and pipe assembly according to claim 2, wherein the second portion is closer than the first portion to the second end of the pipe.

4. A catalytic converter and pipe assembly according to claim 2, wherein the major axis is parallel to an exhaust gas flow axis at the second end of the pipe.

5. A catalytic converter and pipe assembly according to claim 1, wherein the plane of the first end is parallel to an axis of the second end of the pipe, wherein the axis is perpendicular to a direction of exhaust flow through the catalytic converter.

6. A catalytic converter and pipe assembly according to claim 1, wherein the opening is larger than an outer perimeter of the first end and wherein the first end is located within the opening.

7. A catalytic converter and pipe assembly according to claim 1, wherein the opening is smaller than an outer perimeter of the first end and wherein the first end is attached to an outer surface of the housing end.

8. A catalytic converter and pipe assembly according to claim 2, wherein the second portion is located immediately adjacent an edge of the housing end.

9. A catalytic converter and pipe assembly according to claim 1, wherein the change of exhaust flow direction is at least substantially 75 degrees.

10. A catalytic converter and pipe assembly according to claim 1, wherein a diameter of the catalytic converter is less than a length of the major axis.

11. A catalytic converter and pipe assembly according to claim 1, wherein the space not much larger than the diameter of the pipe is less than 1.5 times the diameter of the pipe.

12. A catalytic converter and pipe assembly according to claim 1, wherein the space not much larger than the diameter of the pipe is less than 1.1 times the diameter of the pipe.

13. A catalytic converter and pipe assembly according to claim 1, wherein the change of exhaust flow direction is at least substantially 90 degrees.

* * * * *